US006626081B2

(12) United States Patent
Ho et al.

(10) Patent No.: US 6,626,081 B2
(45) Date of Patent: Sep. 30, 2003

(54) AIR-SEAL STRUCTURE FOR PNEUMATIC NAILERS

(75) Inventors: Roman Ho, Taichung (TW); Jack Chen, Taichung (TW); Hsuan-Chi Chiang, Taichung (TW)

(73) Assignee: Basso Industry Corp., Taichung (TW)

( * ) Notice: Subject to any disclaimer, the term of this patent is extended or adjusted under 35 U.S.C. 154(b) by 0 days.

(21) Appl. No.: 10/053,914

(22) Filed: Jan. 24, 2002

(65) Prior Publication Data

US 2003/0136257 A1 Jul. 24, 2003

(51) Int. Cl.[7] ..... F01B 11/02
(52) U.S. Cl. ..... 91/394; 92/85 R; 227/130
(58) Field of Search ..... 91/394–396, 408, 91/409; 92/85 R; 227/130

(56) References Cited

U.S. PATENT DOCUMENTS 5,441,192 A * 8/1995 Sugita et al. ..... 227/130
5,782,395 A * 7/1998 Sauer ..... 227/130
6,059,166 A * 5/2000 Ho et al. ..... 227/130
6,059,167 A * 5/2000 Ho et al. ..... 227/130

* cited by examiner

*Primary Examiner*—Edward K. Look
*Assistant Examiner*—Igor Kershteyn
(74) *Attorney, Agent, or Firm*—Charles E. Baxley

(57) ABSTRACT

An air-seal structure for pneumatic nailers includes a valve member movably engaged with the end cap of the nailer and a plurality of paths defined radially through a skirt portion of the valve member. The paths are in communication with air release passage defined in the end cap. A seal is mounted to the skirt portion of the valve member and closes the paths. The seal contacts an end of the cylinder when the trigger is not squeezed. The seal is sucked due to the difference of pressure so that it will not be loosened during movement of the valve member. A cushion member is connected to a disk member on the inside of the end cap so as to absorb shocks when the piston returns back to the ready position.

3 Claims, 4 Drawing Sheets

AIR-SEAL STRUCTURE FOR PNEUMATIC NAILERS

FIELD OF THE INVENTION

The present invention relates to a pneumatic nailer wherein a plurality of paths are defined radially through the valve member and a seal between the cylinder and the valve is sucked tightly when the trigger is not squeezed.

BACKGROUND OF THE INVENTION

An air valve for a conventional pneumatic nailer is shown in FIG. 1 and generally includes an end cap 11 connected to a rear end of the body 15 of the nailer and a valve member 12 is movably engaged with an annular space 111 of the end cap 11. Two seals 125, 126 are embedded to the inner and the outer periphery of the valve member 12 and are moved along the surfaces of the annular space 111. A cylinder 16 is received in the body 15 and has a flange 161 which is securely engaged with an inside of the body 15. A seal 112 is connected to the valve member 12 and contacts an end of the cylinder 16 so as to seal the conjunction portion between the cylinder 16 and the valve member 12. The end cap 11 has a tubular portion 121 which has a groove for receiving a spring 13 therein which urges the valve member 12 to let the seal 112 contact the cylinder 16. A piston 18 is movably received in the cylinder 16 and an injection rod 19 is connected to the piston 18. The piston 18 has a protrusion extending through the valve member 12 and contacting an end surface 122 on the tubular portion 121. When the user squeeze the trigger of the nailer, the valve member 12 is moved toward the tubular portion 121 and pressurized air enters the cylinder 16 to move the piston 18 to inject a nail. The seals 125, 126 will be worn out after frequent movement on the surfaces of the annular space 111. The seal 112 hits on the cylinder 16 when the pressurized air is released from release path of the nailer and the valve member 12 is pushed back by the spring 13. This could loosen the position of the seal 112. The piston 18 returns back by the air flow after the nail is injected and the protrusion hits the end surface 122 of the end cap 11. This will shank the whole assembly and leakage could happens.

SUMMARY OF THE INVENTION

In accordance with one aspect of the present invention, there is provided a air-seal structure for pneumatic nailers and the structure comprises a valve member that has a skirt portion movably engaged with an annular space of the end cap and first seals are connected to the skirt portion of the valve member. A spring is biased between the skirt portion and an inside of the annular space. A plurality of paths are defined radially through the valve member and communicate with air release passage defined in the end cap. A second seal is connected to the valve member and closes the paths. The second seal removably contacts an rear end of a cylinder in the mailer body. A cushion member is engaged with a disk member connected to an inside of the end cap and has an recess defined in a side thereof. A piston is movably received in the cylinder and an injection rod is connected to the piston. The piston has a protrusion which is disengagably engaged with the recess.

The primary object of the present invention is to provide an air-seal structure for pneumatic nailers and the structure occupies less space and effectively enhances the air-seal feature of the nailer.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
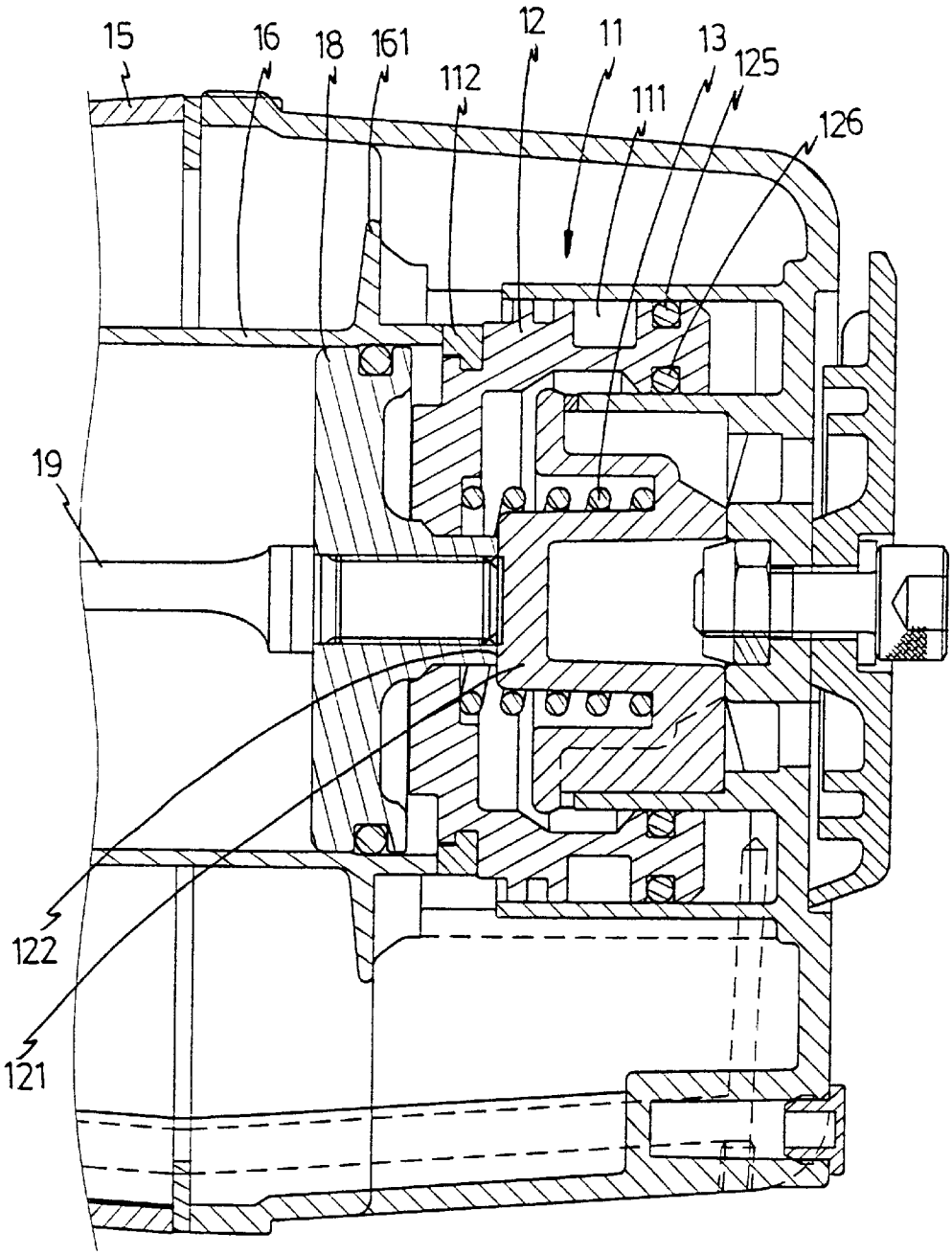
FIG. 1 PRIOR ART
FIG. 1 is a cross sectional view to show the air-seal structure of a conventional pneumatic nailer.
Figure 2:
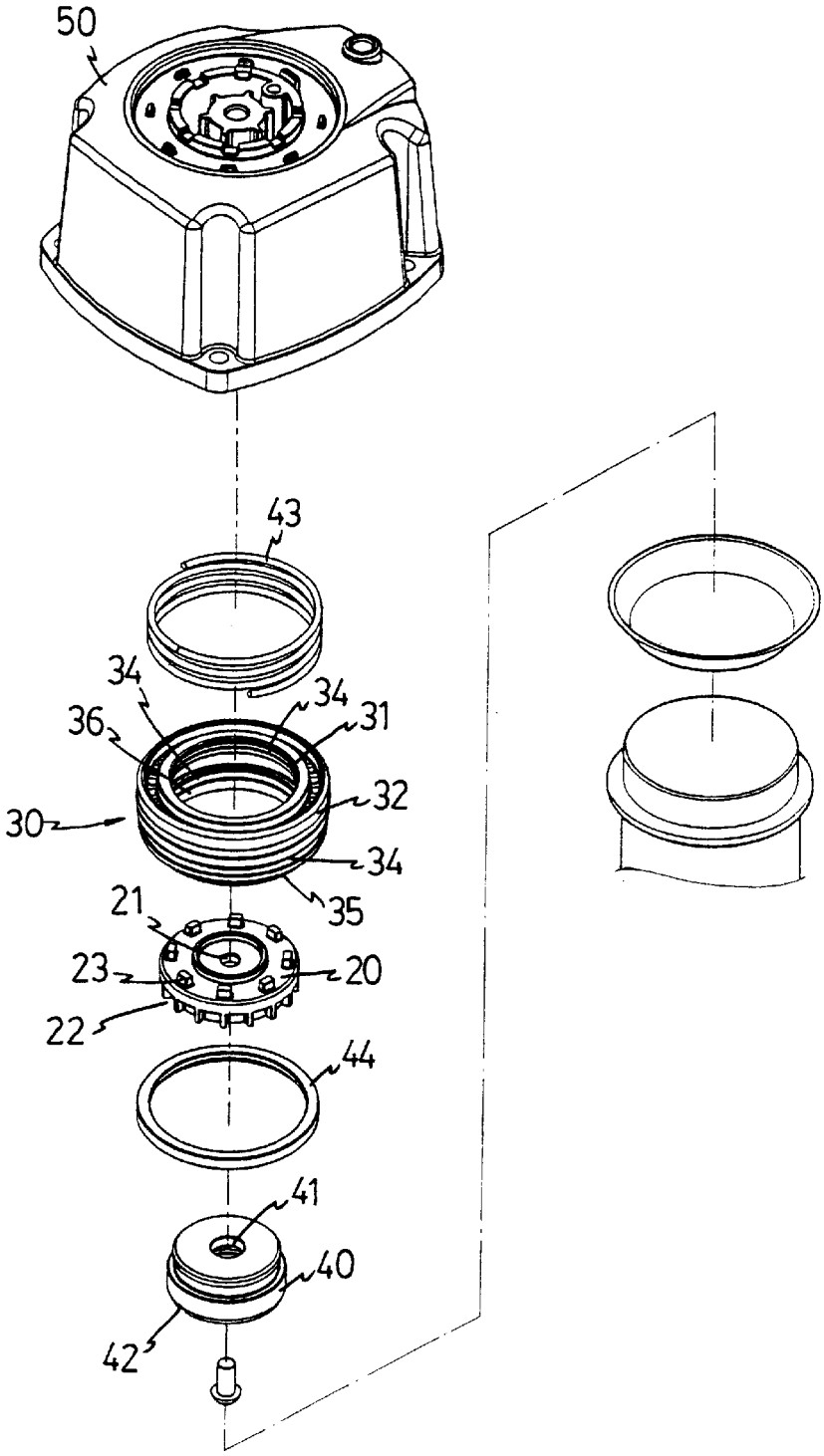
FIG. 2 is an exploded view to show the parts of the air-seal structure of a pneumatic nailer of the present invention.
Figure 3:
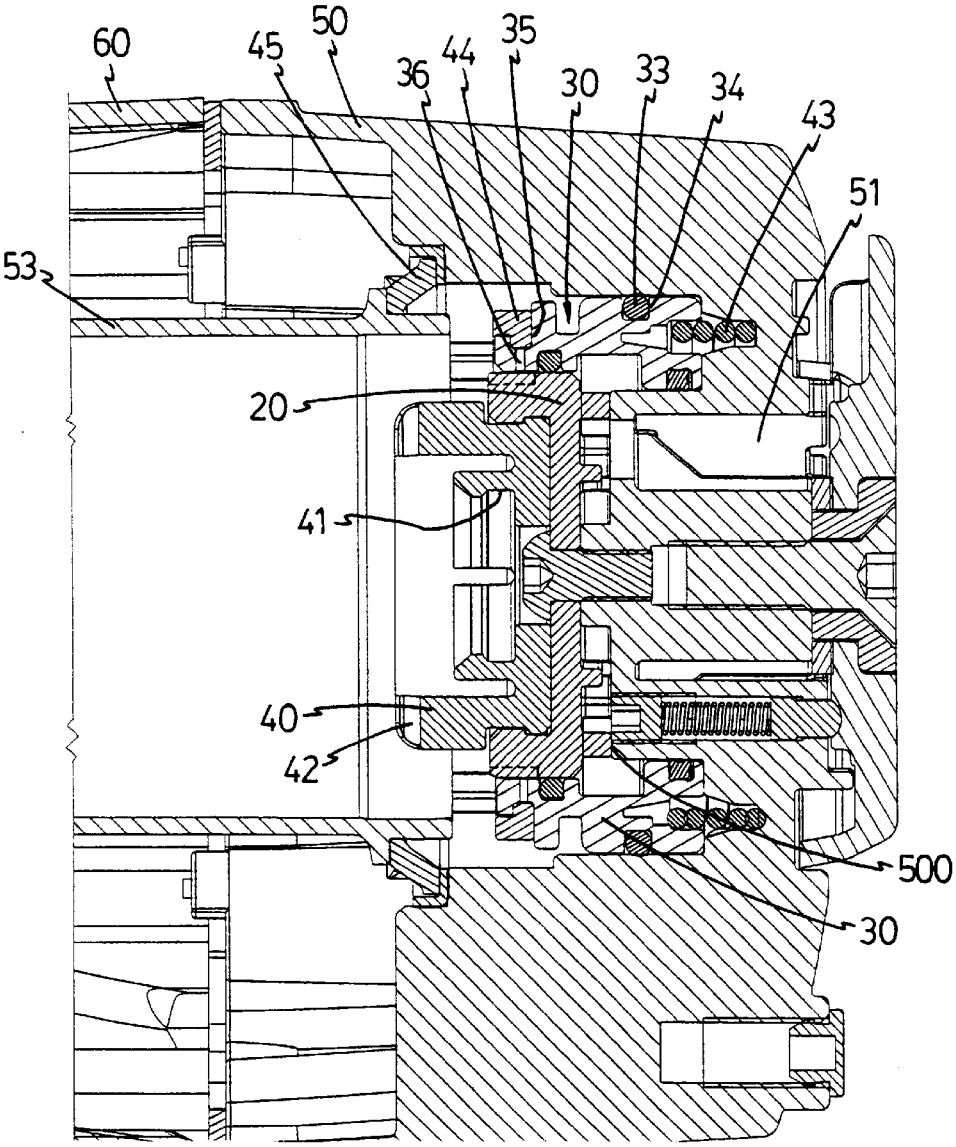
FIG. 3 is a cross sectional view to the air-seal structure of the pneumatic nailer of the present invention, wherein the piston is moved away from the cushion member.

Referring to FIGS. 2 and 3, the air-seal structure of a pneumatic nailer of the present invention comprises an end cap 50 connected to a rear end of a nailer body 60 and an annular space 500 is defined in the end cap 50. A tubular valve member 30 has a skirt portion movably engaged with the annular space 500 and two first seals 33 are received in grooves 34 defined in the skirt portion of the valve member 30 so as to be moved along the two facing inner surfaces of the annular space 500. A spring 43 is biased between the skirt portion and an inside of the annular space 500. A cylinder 53 is received in the nailer body 60 and the spring 43 urges the valve member 30 to contact an end of the cylinder 53. A plurality of paths 36 are defined radially through the valve member 30 and communicate with air release passage 51 defined in the end cap 50. A ring 45 is connected between the end cap 50 and the cylinder 53.

Figure 4:
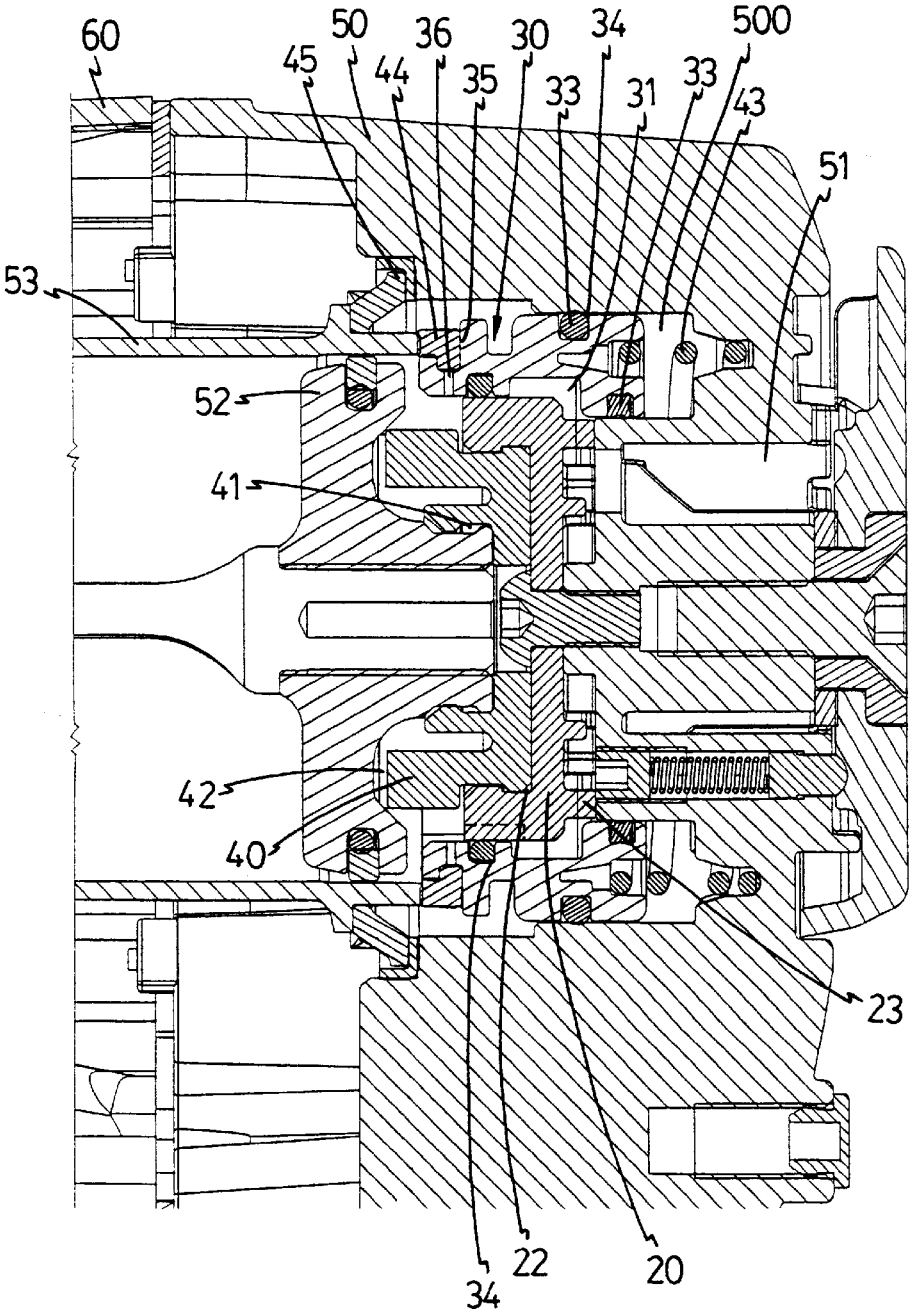
FIG. 4 is a cross sectional view to the air-seal structure of the pneumatic nailer of the present invention, wherein the piston is moved back to the cushion member.

A groove 35 is defined in an end of the valve member 30 so as to receive a second seal 44 therein and the second seal 44 closes the paths 36. The second seal 44 removably contacts an rear end of the cylinder 53 to prevent air from entering the cylinder 53 as shown in FIG. 4.

A disk member 20 is connected to a center portion of an inside of the end cap 50. The disk member 20 has a plurality of bosses 23 extending from a first side thereof and an engaging recess 22 is defined in a second side of the disk member 20. A cushion member 40 is engaged with the engaging recess 22 of the disk member 20 and a recess 41 is defined in a side of the cushion member 40. A screw extends through a hole 41 in the cushion member 40 and the hole 21 in the disk member 20 and is securely engaged with the end cap 50.

A piston 52 is movably received in the cylinder 53 and an injection rod is connected to the piston 52. The piston 52 has a protrusion which is disengagably engaged with the recess 41 of the cushion member 40.

When the trigger is not squeezed, the pressure difference on the two sides of the second seal 44 makes the second seal 44 to be sucked firmly in the groove 35. This feature allows the manufacturers use smaller parts to design the second seal 44. When the trigger of the nailer is squeezed, the pressure enters in the cylinder 53 to move the piston 52 away from the cushion member 40 and after a nail is injected, the air is guided to move the piston 52 back to its ready position as shown in FIG. 4. When the piston 52 returns back, it hits the cushion member 40 and the protrusion is engaged with the recess 41. A plurality grooves 42 are defined in an edge of the cushion member 40 so that when the protrusion enters the recess 41, air in the recess 41 escapes from the grooves 42. The shocks that the piston 52 returns to its ready position are absorbed by the cushion member 40 so that the seals 33, 44 will not be loosened by the shocks and vibration.

While we have shown and described the embodiment in accordance with the present invention, it should be clear to those skilled in the art that further embodiments may be made without departing from the scope of the present invention.

What is claimed is:

1. An air-seal structure for pneumatic nailers, comprising:

an end cap connected to a rear end of a nailer body and an annular space defined in said end cap, a cylinder received in said nailer body and disk member connected to a center portion of an inside of said end cap;

a valve member having a skirt portion movably engaged with said annular space and first seals connected to said skirt portion of said valve member, a spring biased between said skirt portion and an inside of said annular space, a plurality of paths defined radially through said valve member and communicating with air release passage defined in said end cap, a second seal connected to said valve member and closing said paths, said second seal removably contacting rear end of said cylinder;

a cushion member engaged with said disk member and having recess defined in a side thereof, and a piston movably received in said cylinder and an injection rod connected to said piston, said piston having a protrusion which is disengagably engaged with said recess.

2. The air-seal structure for pneumatic nailers as claimed in claim 1 further comprising a ring connected between said end cap and said cylinder.

3. The air-seal structure for pneumatic nailers as claimed in claim 1 further comprising grooves defined in an edge of said cushion member.

* * * * *